United States Patent [19]

St. Amand

[11] 4,181,381

[45] Jan. 1, 1980

[54] FILING DEVICE

[75] Inventor: Robert St. Amand, Springfield, Mass.

[73] Assignee: National Blank Book Company, Inc., Holyoke, Mass.

[21] Appl. No.: 896,489

[22] Filed: Apr. 14, 1978

[51] Int. Cl.[2] ..... A47B 63/00

[52] U.S. Cl. ..... 312/183; 312/184; 312/186; 211/165

[58] Field of Search ..... 312/183, 184, 186, 202, 312/252; 211/123, 124, 165, 169

[56] References Cited

U.S. PATENT DOCUMENTS

| | | | |
|---|---|---|---|
| 928,292 | 7/1909 | Walsh | 211/169 |
| 1,049,886 | 1/1913 | Manson | 211/165 |
| 3,238,947 | 3/1966 | Churnick | 312/184 |
| 3,255,758 | 6/1966 | Gauche | 312/184 |
| 3,298,374 | 1/1967 | Grundell | 312/184 |
| 3,684,340 | 8/1972 | Kirkorian | 312/183 |
| 3,746,180 | 7/1973 | Spiroch et al. | 312/184 |
| 3,885,726 | 5/1975 | Fridlund et al. | 312/184 |
| 3,913,995 | 10/1975 | Malcik et al. | 312/183 |
| 4,053,057 | 10/1977 | Snowden | 312/184 |

FOREIGN PATENT DOCUMENTS

| | | | |
|---|---|---|---|
| 630877 | 12/1961 | Italy | 312/184 |
| 625352 | 6/1949 | United Kingdom | 312/184 |

*Primary Examiner*—Victor N. Sakran

*Attorney, Agent, or Firm*—Chapin, Neal & Dempsey

[57] ABSTRACT

A hanger filing device adaptable for horizontal and vertical file orientation includes an integral binder element comprising a pair of longitudinally extending spaced flanges which define an open channel for receiving file material. A hinge pin is disposed within the binder element and extends outwardly of the ends thereof. The flanges include notched extensions for slidably engaging spaced rails of a hanging file rack. The flanges include spaced opposed apertures dimensioned to receive any of a variety of fastening devices for binding file material between the flanges. The hinge pin provides a post support for the vertical disposition of the binder element within an upright file.

7 Claims, 5 Drawing Figures

Fig. 3.
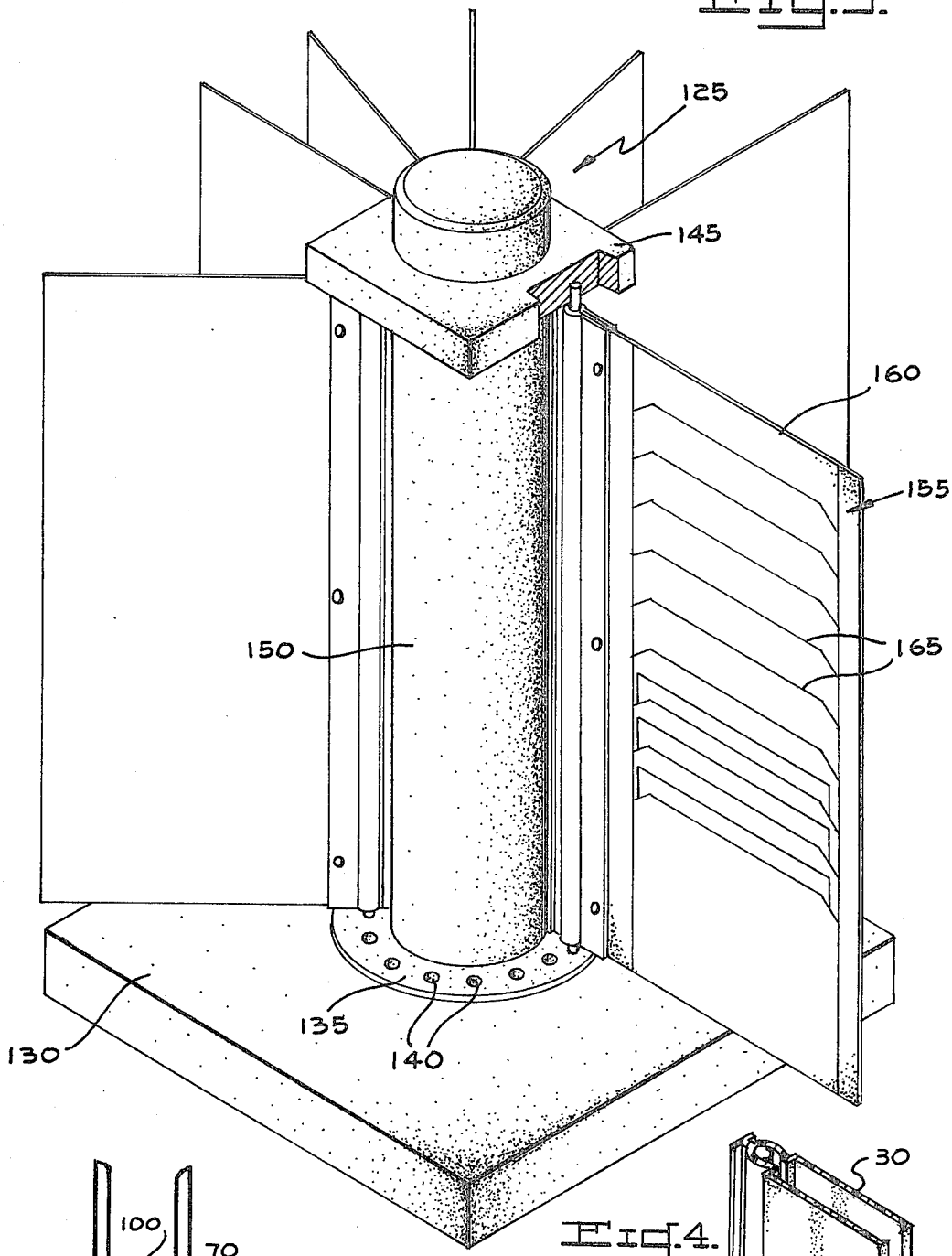
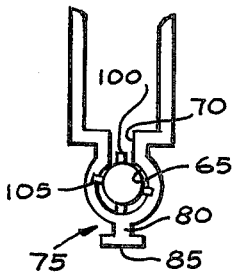
Fig. 5.
Fig. 4.
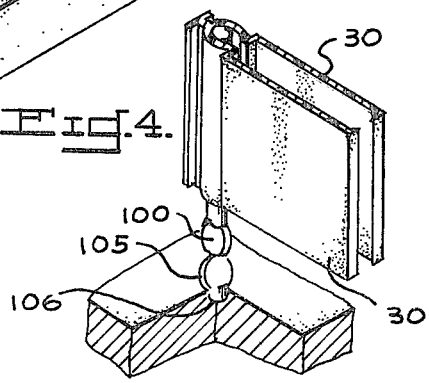

FILING DEVICE

BACKGROUND

This invention relates to filing equipment and particularly filing equipment adaptable to use with both hanger type and upright type filing systems.

Hanger type file systems wherein printed file material is suspended by a binder or spine having hooked ends which slidably engage parallel, spaced support rails of a file drawer have enjoyed a sustained popularity for business record keeping. To reduce the bulk record storage, many businesses have turned to the storage of information on magnetic tape, flexible magnetic discs known as floppy discs and/or the photo-reduction of printed records as on microfiche. Such magnetic or photo-reduced information is commonly stored upright in pivotable engagement with an upstanding post which may be stationary or rotatable as in what is commonly referred to as a carrousel type file. Such files involve the use of holders for the magnetic or photographic records for removably attaching the same to the carrousel stand. Since record storage may involve handling information in printed and magnetic or photo-reduced form, it will be appreciated that various types of devices are required. For purposes of versatility and economy, a device adapted to both hanging and upright file systems is desirable.

Accordingly, it is a principal object of the present invention to provide a filing device adaptable for use in hanging type file drawer systems as well as upright file systems.

It is another object of the present invention to provide such a filing device which is convenient to use and economic to manufacture.

These and other objects will become more apparent from the following detailed description taken in connection with the accompanying drawings.

DESCRIPTION OF THE DRAWINGS

FIG. 3 is a perspective view of the filing device employed in an upright file;

FIG. 4 is a partial perspective view of the lower end of the filing device shown in FIG. 3 with the device being raised from the end portion of a pivot pin employed therewith; and FIG. 5 is an enlarged end view of the filing device.

DESCRIPTION OF THE PREFERRED EMBODIMENT

Figure 2:
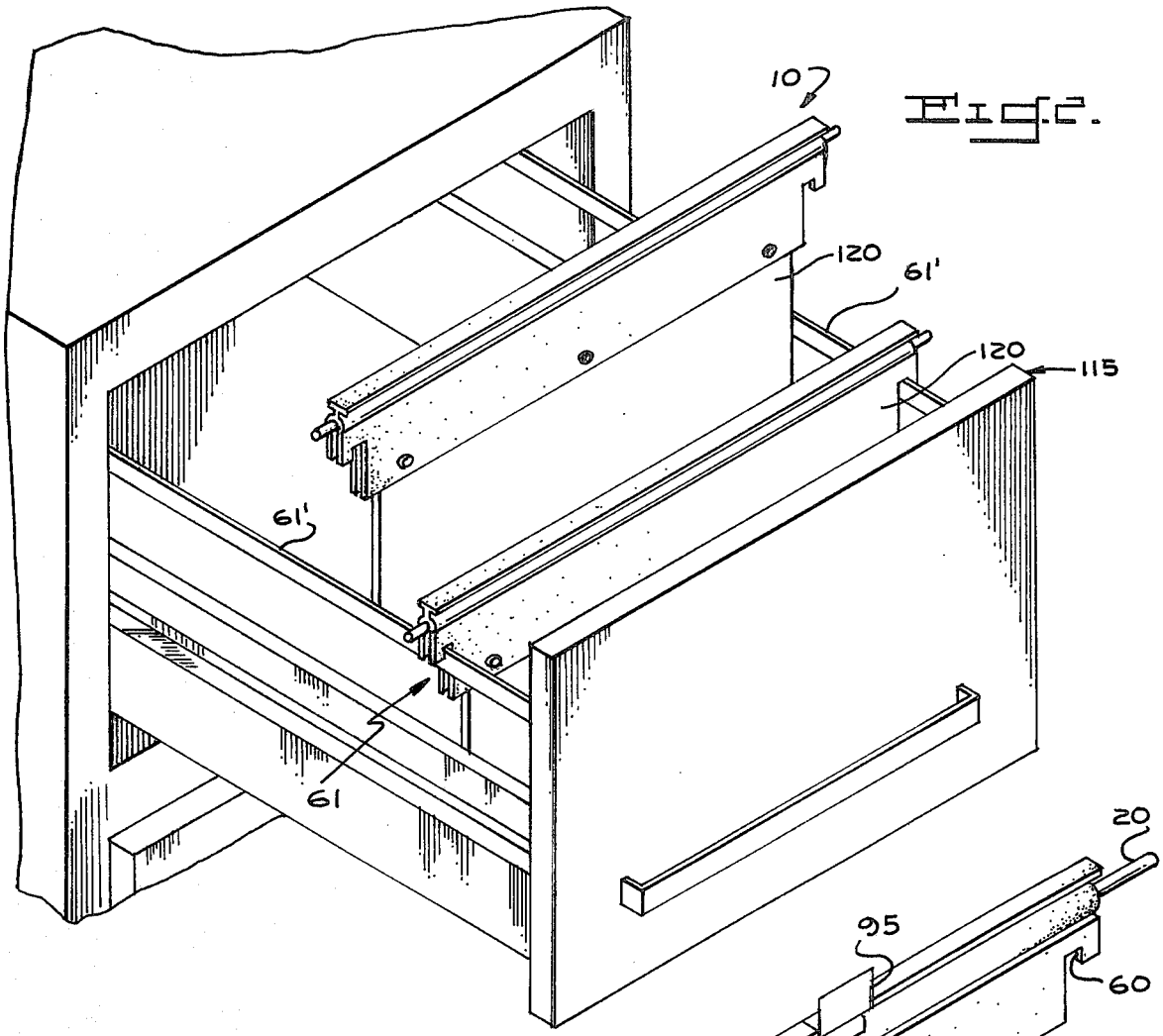
FIG. 2 is a perspective view of the filing device employed in a file drawer hanging type file.

Referring to the drawings, the filing device of the present invention is shown generally at 10 and comprises an integral, channel shaped strip 15 which is adapted to receive therein a pivot pin or rod 20 and a plurality of fasteners 25 for securing the binder edge of the file material within the strip.

Channel strip 15 is formed of any suitable material such as a synthetic plastic extrusion which provides a stiffly resilient binder strip. The strip includes spaced parallel flanges 30 defining an open channel 35 for receiving file material therebetween. The flanges are of a resilience sufficient to firmly grip the file material therebetween and for more positive gripping, each is provided with an inwardly extending lip or rib 40 adjacent the outer edge thereof.

Each flange includes longitudinally spaced apertures, two of which are shown at 45. The apertures of each flange are disposed in alignment with the apertures of the opposed flange; each pair of spaced opposed apertures is adapted to receive a fastener 25 for positively securing the file material between the flanges. The fasteners shown are well known in the art, being commonly referred to as snap fasteners and include a head element 50 and a pluarlity of splayed tangs 55 extending therefrom. The resilience of the tangs maintains the fasteners in firm registry with the flange apertures.

The binder element includes outwardly extending hook portions 60 adapted to slidably engage the spaced rails as shown at 61 in FIG. 2. The hooks 60 are in the form of downwardly opening U-shaped notches or slots which are shaped to fit easily over the rails 61' of a standard hanger type file drawer.

Binder strip 15 also includes a generally cylindrical bore or cavity 65 into which pivot pin 20 is fitted. The cavity 65 communicates with the inner end of channel 35 through a longitudinal slot 70.

Figure 1:
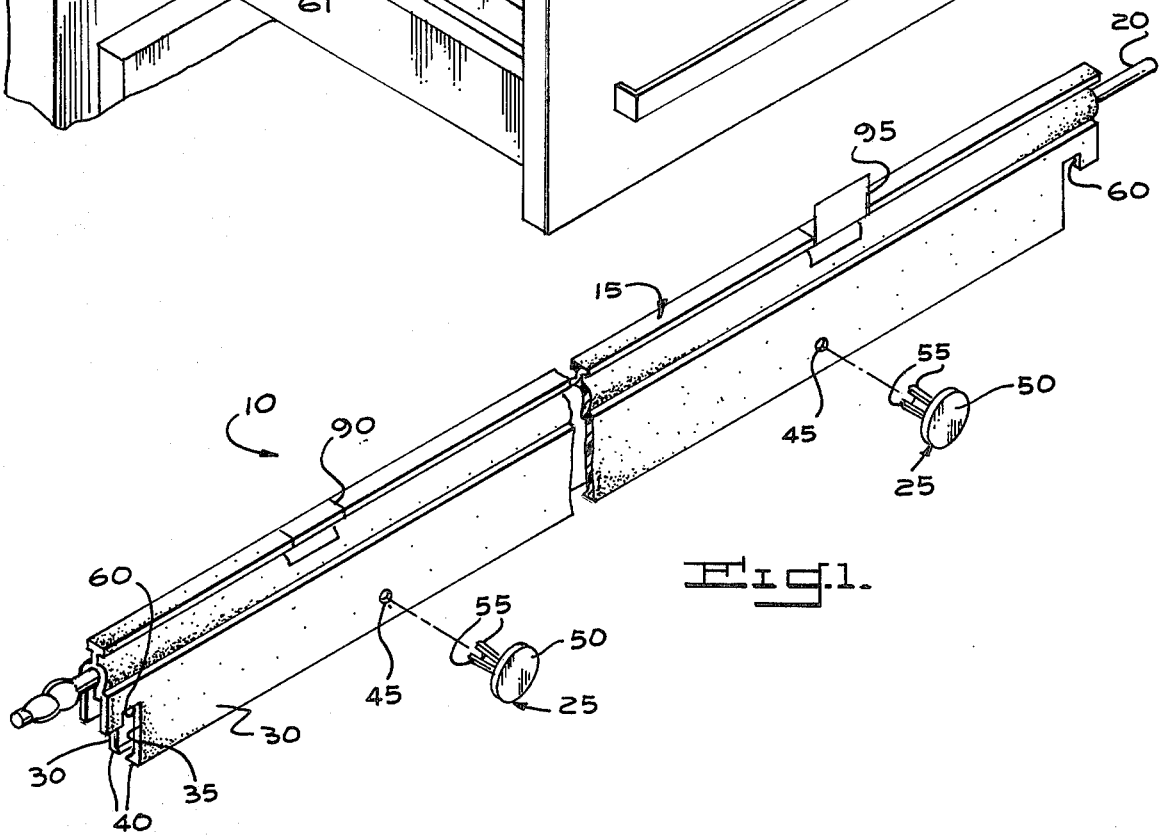
FIG. 1 is a perspective view of the filing device of the present invention.

Adjacent the juncture of the flanges, binder element 15 is provided with an index mounting flange 75 which is generally T-shaped in cross section including an upright 80 and a transverse rib 85. Rib 85 may carry index tabs such as those shown at 90 and 95 (see FIG. 1) for identifying the contents held by each binder strip 15. Index tabs 90 and 95 include T-shaped open channel base portions which are slidable onto the ends of the binder strip.

As discussed above, a pivot pin 20 may be disposed in longitudinal cavity 65 and provides a support member by which the binder may be mounted in the vertical carrousel file as shown in FIG. 3. In the preferred embodiment, the pin comprises a metallic rod with a pair of adjacent angularly offset flanges or lugs 100 and 105, the transverse dimensions of which are substantially greater than the diameter of rod 20 and bore 65. As best shown in FIG. 5, the major dimensions of lugs 100 and 105 are circumferentially offset by a substantial angle. As shown in FIG. 5, when the pivot pin is assembled with the binder element for use in an upright file arrangement, lug 100 fits snugly into bore 65 so as to prevent rotation of the pin 20 relative the binder strip. The lug 100 tends to align itself so that its inner edge is received within slot or throat 70. Lug 105 extends outwardly of the end of the binder strip and its lower end 106 is received within a recess 140 provided in base member 130 of an upright file rack or stand as shown in FIG. 3.

FIGS. 2 and 3 illustrate two different uses of the filing device of the present invention. Referring to FIG. 2, the filing strip is shown supported by spaced rails 61' in a hanging file well known in the art. Rails 61' are fixed to the interior of a file cabinet drawer 115, but it will be appreciated that the device is equally well suited for use with stationary hanging file stands or racks, such as the type illustrated in U.S. Pat. No. 3,684,340 to Krikorian. The filing device is slidably received on the rails at recesses 60 allowing movement of the device on the rails for ease in insertion and removal of the file material from the drawer and visual inspection of the material while positioned on the rails. File material 120 held by the device may include any documentary material such as pamphlets, catalogues, loose documents, file folders or other material conveniently stored in such a file.

As discussed above, modern business practices require the storage of information on magnetic and/or micrographic recording media. Such file materials are most conveniently stored in upright file racks or stands, such as, for example, those of the carrousel variety. The filing device of the present invention is as well suited for such upright file applications as for a hanging file application as illustrated in FIG. 2.

Referring to FIG. 3, filing device 10 is shown mounted in an upright file rack or stand 125. Stand 125 comprises stationary base 130 which may include a rotatable lower support 135 having circumferentially spaced recesses 140 which pivotally receive the lower ends 106 of pivot pins 20. The upper end of each pin 20 is pivotally received within similar spaced recesses in a header 145 which is supported by post 150 rotatably supported by base plate 135. It will be understood then that access to a particular file pouch 155 is achieved by rotation of column 150 to orient the particular file sheet in a convenient radial direction. Thereafter the individual file sheet may be swung on its pivot pin for convenient access to the material filed therein. For compactness in the arrangement shown in FIG. 3, the hanger extensions have been omitted but may be left in place when the unit is used in a carrousel stand as well as a hanger file. As illustrated in FIG. 3, the file material comprises a panel 160 provided with a plurality of vertically spaced pockets 165 which receive microfiche or other micrographic information recording media. Such microfiche storage panels are sold by the assignee of the present invention under the trademark "Micrographics". Although a microfiche storage panel is illustrated in FIG. 3, the filing device is equally well adapted for the filing of other micrographic material as well as magnetic recording material, such as tape cassettes, flexible or "floppy" discs and the like or any other material commonly filed in an upright orientation.

It will be appreciated that the filing device of the present invention provides a versatile means for binding and storing material in both upright and hanging files, thereby eliminating the need for having single purpose filing devices adapted for only one utility.

While there has been shown and described a single embodiment of the filing device of the present invention, it will be understood that modifications may be made without departing from this invention and it is intended by the appended claims to cover such modifications as come within the true spirit and scope of this invention.

Having thus described the invention, what is claimed is:

1. A binder and filing device adapted for both horizontal and vertical disposition in hanger and carrousel type files comprising a unitary, resilient strip of generally channel shaped cross section defined by laterally spaced flanges and a longitudinally extending cavity vertically disposed above said channel, said strip including downwardly opening notches formed in the outer end portions of said laterally spaced flanges extending outwardly of the ends thereof and being adapted for engagement with support rails of a file drawer, a rod removably disposed in said cavity and extending longitudinally outwardly from the ends thereof, said rod being adapted to pivotally secure said strip in a vertical orientation between supports in an upright file rack.

2. The binder and filing device of claim 1 wherein said flanges are provided with a plurality of spaced opposed pairs of apertures adapted to receive fasteners therethrough for the securing of the binder edge of hole punched file material between said flanges.

3. The binder and filing device of claim 1 wherein a longitudinally extending slot communicates from the channel defined by said flanges to said cavity.

4. The filing device of claim 1 and further including a longitudinally extending index tab mounting flange at a marginal edge of said binder strip opposite said channel opening.

5. The binder and filing device of claim 3 wherein said rod is provided at an end portion thereof with at least one lug having a transverse dimension greater than the diameter of said rod, said lug being adapted to fit snugly within said cavity and slot and prevent relative rotation of the rod and strip.

6. The filing device of claim 4 wherein said index tab mounting flange is of T-shaped cross section.

7. The filing device of claim 4 wherein an edge portion of each of said flanges at adjacent the outer edge thereof includes an inwardly extending rib for the maintenance of firm engagement of the file material by said binder strip.

* * * * *